US006062371A

United States Patent [19]

Drügh et al.

[11] Patent Number: 6,062,371

[45] Date of Patent: May 16, 2000

[54] METHOD OF AND APPARATUS FOR THE BRAKING AND DELIVERING OF ROLLED PRODUCTS

[75] Inventors: Hans-Peter Drügh, Zülpich; Erich Grossmann, Tönisvorst, both of Germany

[73] Assignee: SMS Schloemann-Siemag AG, Dusseldorf, Germany

[21] Appl. No.: 09/038,532

[22] Filed: Mar. 11, 1998

[30] Foreign Application Priority Data

Mar. 15, 1997 [DE] Germany ..... 197 10 898

[51] Int. Cl.[7] ..... B65G 47/26

[52] U.S. Cl. ..... 198/418.1; 198/433

[58] Field of Search ..... 198/418.1, 433, 198/468.2, 468.6, 468.8

[56] References Cited

U.S. PATENT DOCUMENTS

| | | | |
|---|---|---|---|
| 4,488,632 | 12/1984 | Focke et al. | 198/418.1 |
| 5,301,794 | 4/1994 | Tomasetig | 198/433 |
| 5,501,314 | 3/1996 | Tomat et al. | 198/418.1 |

FOREIGN PATENT DOCUMENTS

| | | |
|---|---|---|
| 7 011 686 | 2/1972 | Germany . |
| 1 421 57 | 6/1980 | Germany . |
| 0 159 728 | 10/1985 | Germany . |
| 0 114 791 | 8/1994 | Germany . |
| 0 636 430 | 2/1995 | Germany . |

*Primary Examiner*—James R. Bidwell
*Attorney, Agent, or Firm*—Herbert Dubno

[57] ABSTRACT

An apparatus for braking the travel on oncoming rolled products and depositing the rolled products on a cooling bed or other collector as a support frame extending in the direction of travel of the rolled workpieces and an array of profile braked members which can be U-shaped and open toward brake surfaces on the support frame. The U-shaped brake members are pressed against the workpiece to clamp it against the braking surface. The brake members can be swung pendulum fashion so that angled legs beneath the workpieces can be swung away to allow them to drop on the cooling bed or other collector.

8 Claims, 3 Drawing Sheets

METHOD OF AND APPARATUS FOR THE BRAKING AND DELIVERING OF ROLLED PRODUCTS

FIELD OF THE INVENTION

The present invention relates to an apparatus for braking and delivering rolled products of different lengths to a cooling bed or directly to a collecting unit. The invention also relates to a method of operating such an apparatus.

BACKGROUND OF THE INVENTION

In a rolling line, it is frequently desirable to provide an apparatus for braking the rolled product from the relatively high velocity at which it is rolled and for delivering that product to a cooling bed at an interface between the rolling line and the cooling bed.

Before a finish-rolled and subdivided rolled product, usually at a desired length can be allowed to pass onto the cooling bed or even to be transferred to a collecting system for gathering the successive lengths of rolled products, it is important that the rolled product be brought to standstill. Only after the product has been brought to standstill is it possible to transfer the rolled product to the cooling bed effectively or to the collection unit or to enable the product to slide into the next available seat in a cooling bed. Since rolled products of different dimensions are produced in a rolling line, one cannot exclude the possibility that successive lengths of rolled product may have different velocities in the rolling line and may arrive at the braking apparatus at different velocities.

Nevertheless in each case and independently of the length of the rolled product or the speed at which the braking device encounters it, the rolled product must be brought to standstill before it is transferred to the cooling bed or the collecting unit or permitted to slide onto a straightening grate which may be located ahead of that cooling bed or collecting unit.

The apparatus which has hitherto been provided for such braking and rolled product transfer has usually been equipped with so-called transverse conveyor rollers which receive the rolled product from the rolls of the rolling line and feed the rolled product transverse to the transport direction onto the cooling bed.

In a braking region turned toward the cooling bed the transverse conveyors are arranged to brake the rolled product before the rolled product at standstill is deposited by the transverse conveyors onto the cooling bed.

A braking chute, especially for braking rod-shaped rolled products, has been described in German Democratic Republic Patent DD-PS 142 157. The braking force is here generated by electromagnetic or permanent magnets. The braking action of this system, however, has an effect upon the rolling process since the length of the braking path is a function of the weight and speed of the rolled product.

If, for example, the rolled product is too massive and the rolling speed is high, the braking path required to bring it to standstill may exceed the capacity of this type of braking unit and thus the braking unit can impose limits on the products rolled and the operating conditions in the rolling line.

OBJECTS OF THE INVENTION

It is the principal object of the present invention, therefore, to provide a braking apparatus for the purposes described which is capable of braking rolled products moving at higher velocities than as hitherto been the case in rolling mills and rolling lines and thus can afford a significant reduction in the braking path, thereby eliminating drawbacks of earlier systems.

Another object of the invention is to provide a method of operating an improved braking and transfer unit so that the braking path or travel is shorter than has hitherto been the case.

Still another object of this invention is to provide an improved apparatus for the braking and delivering of rolled products and a method of operating same, whereby drawbacks of earlier systems can be avoided.

SUMMARY OF THE INVENTION

These objects and others which will become apparent hereinafter are attained, in accordance with the invention, by substituting for the roller conveyer onto which the rolled product has been passed heretofore and equipped for electromagnetic braking of the rolled product and/or with roller brakes, a mechanical brake which directly engages the rolled product and simultaneously serves to transfer the rolled product onto the cooling bed.

According to a feature of the invention, a support frame is arranged in the direction of movement of the rolled product to be braked and has at least one braking surface mounted thereon. Against this braking surface, a plurality of transverse profiles which are downwardly angled and whose longitudinal axes extended in the direction of movement of the rolled product can be swung back and forth (in a pendulum action). Each downwardly angled profile in the braking position forms together with the braking surface a laterally and downwardly bounded chamber and upon swinging of the profile away, the rolled product which lies upon the lower shank or leg, is released.

Upon the entry of the rolled product to the device, the angled profiles are initially spaced from the support frame so that the laterally and downwardly bounded space receives the workpieces. At the beginning of the travel into the space, the distance between each braking surface and the lateral wall or flank of the profile is so selected that the rolled product passes without restriction as a result of its transport speed from the roller conveyer into the downwardly bounded chamber.

Essentially the velocity of the rolled product effectively shoots the rolled product into that chamber.

During this entry of the rolled product, the angled profiles are swung progressively closer toward the rolled product, thereby displacing the braking surfaces closer to the rolled product so that the rolled product is pressed between the angled profiles and their braking surfaces.

As a consequence, the individual braking surfaces engage the rolled product successively and the result is the desired controlled braking of the travelling rolled product to standstill in a relatively short distance.

The cooling bed or the collecting unit is located below the braking apparatus transverse to the direction of movement of the rolled product.

The rolling speed can be further increased when on both sides of the support frame respective braking surfaces are mounted, against which respective braking surfaces are mounted, against which respective pluralities of downwardly angled profiles can be swung back and forth.

More particularly, the apparatus according to the invention can comprise:

an elongated support frame extending in a direction of travel of oncoming rolled products from a rolling line and having at least one brake surface extending in said direction;

a plurality of profiled brake members juxtaposed with said brake surface, spaced apart in said direction and having downwardly extending legs and shanks angled inwardly from said legs toward said frame, said profiled brake members defining compartments with said brake surface receiving a rolled product, said profile brake members confining said compartments laterally and from below; and actuating means connected with said profiled brake members for swinging same in a pendulum movement toward and away from said brake surface transversely to said direction to brake advance of a rolled product between said profiled brake members and said braking surface upon movement of said profiled brake members toward said frame and to enable a braked rolled product to deposit upon a collector upon movement of said profiled brake members away from said frame.

Since the rows or arrays of profiled brake members are provided on opposite sides of the preferably rectangular cross section frame, along which respective brake pads can be arrayed to form the respective braking surfaces, the rolled product can be alternatingly delivered to the compartments on one or the other side of the frame. For that purpose, upstream or ahead of the braking apparatus, means can be provided for diverting the oncoming rolled product to one or the other of the rows of the compartment.

An important advantage of the apparatus of the invention, is that, while a rolled product is braked to standstill along one side of the frame, a previously braked rolled product on an opposite side of the frame can be deposited upon the collector which can be the cooling bed or some other apparatus collecting the rolled product and extending below the braking apparatus transversely to the direction of displacement of the rolled product into the apparatus.

When the rolled product first enters the initial compartment defined by an array of the profiled brake members and the brake surface along the frame on a respective side of the latter, the profiled brake member and the brake surface are spaced from the rolled product sufficiently to avoid hindering entry of the rolled product into the compartment. Thereafter and during the travel through the compartments, the profiled brake members are applied successively against the rolled product and press the latter against the brake surface, thereby rapidly bringing the rolled product to standstill. During this operation, the compartments are closed laterally and from below by the profile brake members on the one side of the frame at which braking occurs. On the opposite side of the frame, the angled brake members are drawn away from the brake surface to open the compartments from below and permit the rolled products to drop onto the cooling bed or other collector. The swinging of the profiled brake members to and fro on each side of the frame allows the rolled product to be braked first on one side than on the other.

Advantageously, the rectangular section frame has vertical side walls on which the brake surfaces are fixed while the profiled brake members are of U-section and open toward these vertical sides or flanks of the frame. Respective levers are connected to the profiled brake members and pivotally mounted above the frame.

Each of the levers can be provided with an arm which can be actuated by an appropriate drive, e.g. a motor driven cam arrangement. Each lever may be connected to a lever extending to a profiled brake member of the array on the opposite side of the frame.

The braking effect can be increased by the use of weights or springs which can be applied to the U-shaped profiled brake members. Indeed, the brake members themselves may be made relatively massive so that the weight of the brake member contributes to the braking effect. The cam arrangement can be such that the profiled brake members of each array are individually displaced toward and away from the respective brake surface and instead of a rotary cam and a motor for driving same, the levers can be actuated by fluid operated cylinders and/or replaced by fluid operated cylinders which can displace the profiled brake members. Depending upon the weight of the rolled products, the speed at which the rolled product enters the braking device can be controlled.

To this end, means can be provided upstream of the braking apparatus for selectively accelerating the rolled product. Very heavy rolled products which have relatively low speeds may not have sufficient energy to carry them fully into the braking device and for this purpose acceleration may be desirable. A full introduction of the rolled product in the braking apparatus is desirable to insure that the fully braked products will deposit in the cooling bed or other collector in appropriate positions.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
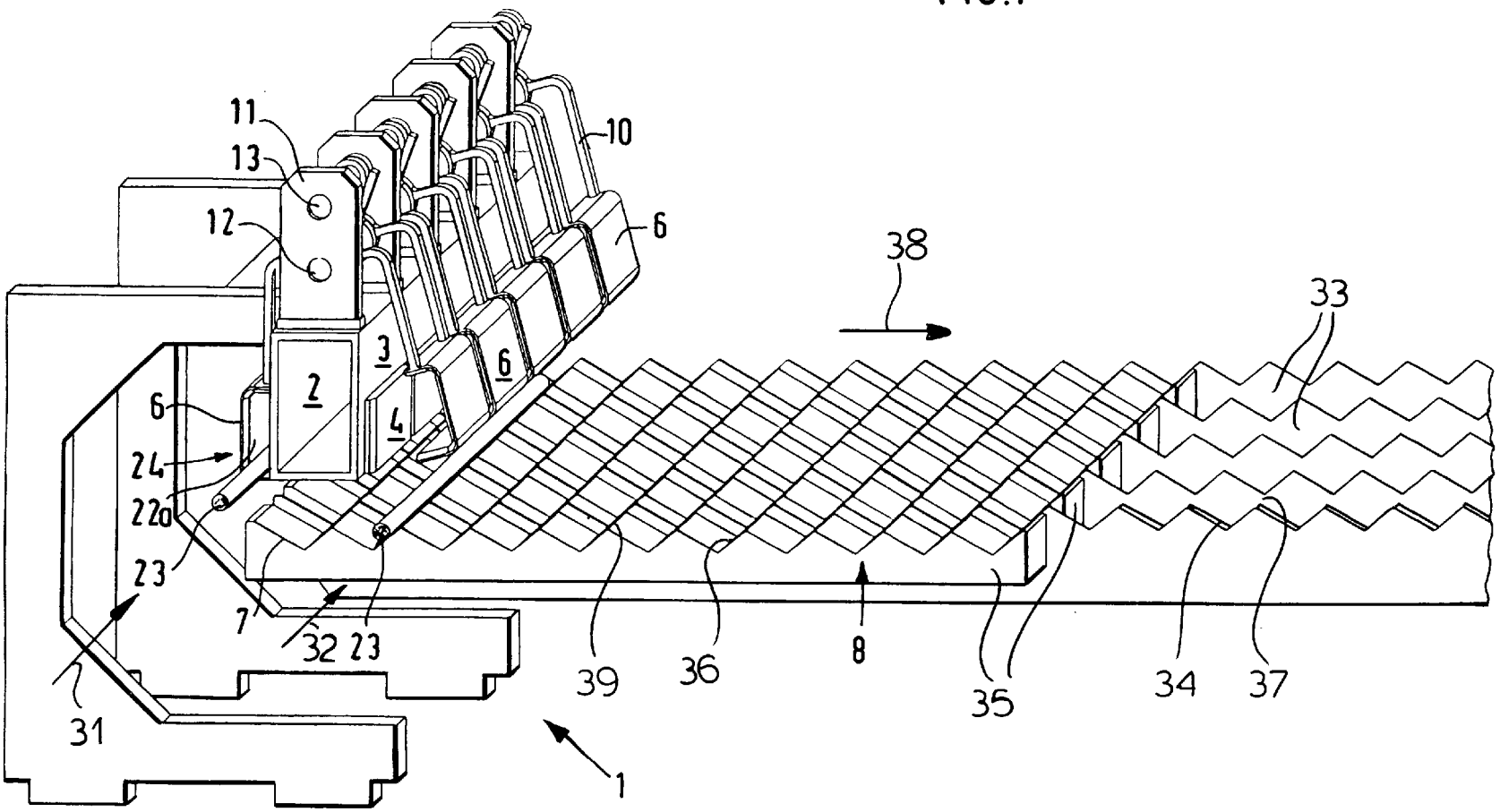
FIG. 1 is a perspective view of an apparatus according to the invention diagrammatically showing a cooling bed as the collector.

The braking apparatus shown at 1 in FIG. 1 is utilized to brake rolled products arriving from a rolling line in a rolling mill and for depositing them upon another unit, such as a cooling bed or other collector. The apparatus comprises a rectangular cross section frame 2 which is elongated in the direction of travel of the rolled products, represented by the arrows 31 and 32 in FIG. 1. The frame 2 has vertical side walls 3 on which respective brake surfaces are provided, the brake surface having a plurality of brake pads 4 spaced apart in the direction of travel of the rolled products, i.e. in the direction of the arrows 31 and 32.

Figure 2:
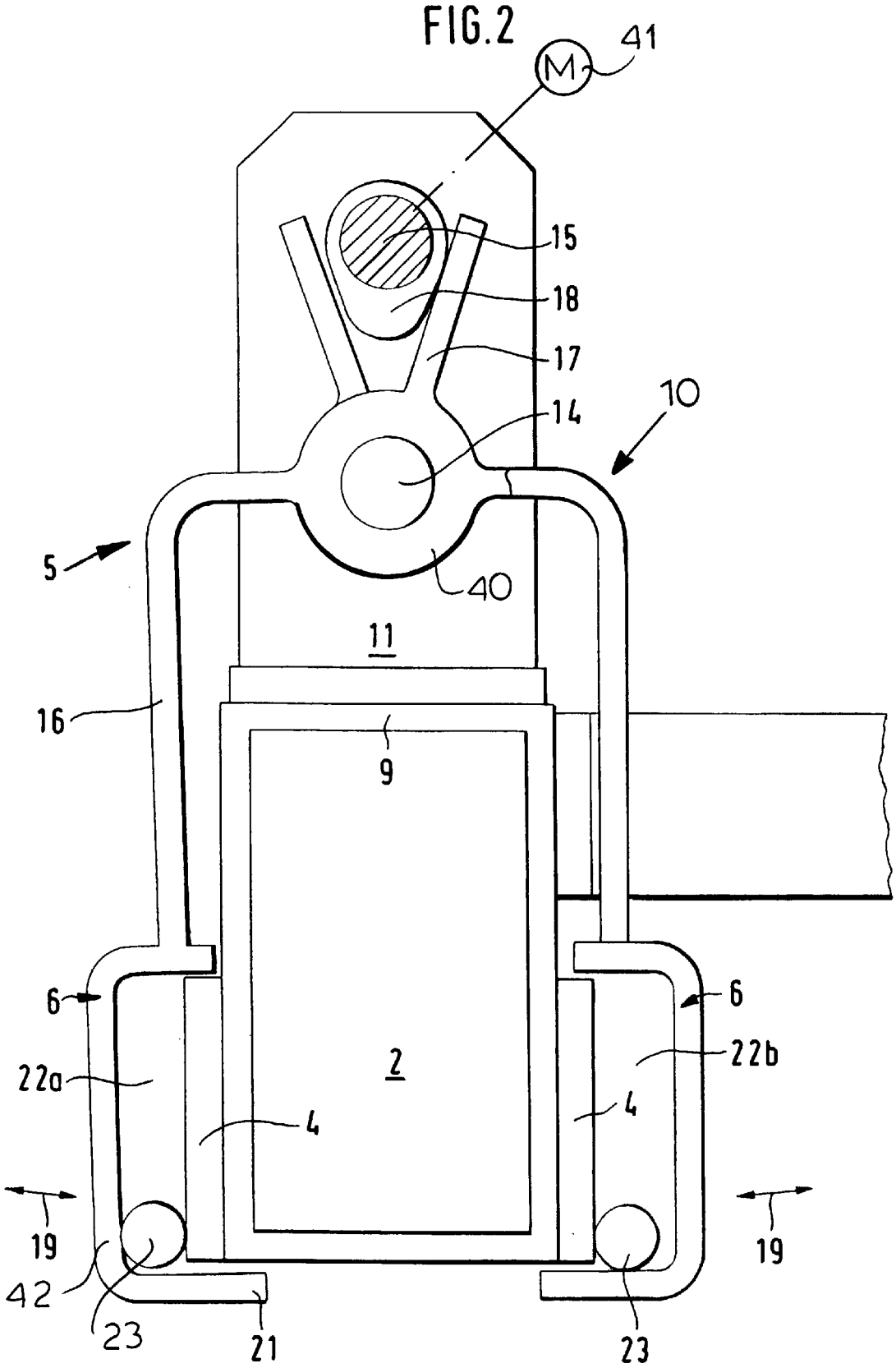
FIG. 2 is a front view of the apparatus partly broken away so as to show the cam for displacing the brake members.

On both sides of the rectangular section frame 2, respective arrays or rows of U-section profiled brake members 6 are provided. These brake members, five in number on each side, are carried by respective lever arms and are swingable toward and away from the respective brake surfaces 4 in a pendulum movement as represented by the double headed arrows 19 in FIG. 2.

Below the frame 2, a straightening grate 7 is provided as part of a cooling bed 8. While the particular collecting unit is not of independent significance, its association with the brake device can be considered a part of our invention and thus the combination of the cooling bed with the braking apparatus is deemed to be a part of this invention.

The cooling bed can comprise a plurality of support plates 33, extending transversely to the rolled products 23 and to the direction 31 or 32 of advance thereof, beneath the braking device. These stationary plates are formed with rows of recesses or pockets 34 in a sawtooth pattern. Between the plates 33, beams 35 are mounted and move in an oscillatory beam conveyer, the upper surfaces of the beams 35 being provided with pockets 36 in a sawtooth pattern. In the lower positions of the beams 35, shown in FIG. 1, each bar 23 can be supported in the pockets 34 and 36 of both the beams and the plates.

To advance the beams along the cooling bed, the beams are raised slightly to carry workpieces over the crests 37 of the plates and then drop down to deposit the rolled products 23 in the pockets 34 of the plates one step along the cooling bed in the direction of arrow 38. The beams 35 are then lowered until their crests 39 are below the troughs 34, the beams are then moved back opposite the direction of arrow 38 and rise until the crests 37 and 39 are aligned as has been shown in FIG. 2 to enable an additional rolled product 23 to be deposited. This is the typical action in a walking beam conveyer and advances the work pieces along the cooling bed.

On an upper wall 9 of the rectangular cross section frame 2, a plurality of bearing plates 11 are mounted, the upwardly extending bearing plates having aligned passages 12, 13 for a pair of rotatably journalled shafts 14 and 15. The shaft 14 can carry the levers 10 which may be inverted L-shaped arms 16 extending in opposite directions from bushings 40 and provided with arms 17 which can be engaged by one or more motor driven cams 18 on the shaft 15. Individual cams can be provided for individual pairs of brake members 6 along opposite sides of the frame 2 or all of the brake members on each side can be jointly moveable with a single cam. The shaft or the cams can be driven by one or more electric motors represented at 41. The cams cause the brake members 6 to swing as shown at 19 toward and away from the brake surfaces 4.

In FIG. 1, the members 6 on the left side of the frame 2 are shown in their braking positions (FIGS. 1 and 2), the lower legs 21 extending below the braking surface 4 to close the braking compartment 22 from below. The substantially vertical shank 42 laterally closes the compartment 22*a*.

At the right hand side of the frame 2, the compartment 22*b* is sufficiently open so that a rolled product 23 can pass into the compartment being limited by a braking action and it will be understood that the position shown on the right and left sides of the frame 2 do not represent simultaneous positions of the brake members on opposite sides of the frame 2 since, when the brake profile 6 clamp the workpiece 23 against the pads 4, the profile member 6 on the right side are swung away from their brake pads 4 by an amount switched to enable the workpieces 23 to deposit on the cooling bed (compare FIG. 1). After the braking has been completed on the left side, the cams 18 swing the profiled brake members 6 of the left side away from the frame 2 and close the compartments 22*b* sufficiently to receive a workpiece 23 at the right hand side of the frame 2 so that such workpiece can pass unhindered into the compartment.

After braking is completed on the left hand side of the frame, the braked workpiece drops onto the cooling bed. Thus while one bar-shaped rolled product 23 is passing into the compartments the profile member 6 are successively approached toward the brake pads 4 to brake the travel of the workpiece (left side of FIG. 1) while a previously braked workpiece is dropped onto the cooling bed. With respect to the showing at the right hand side of FIG. 2, it should be noted that as the member 23 continues to travel into the compartments 22*b*, the profiled brake member 6 progressively are swung inwardly to brake the travel of the workpiece. The arrangement of brakes on both sides of the frame 2 which can be individually controlled by the cams 18 insures a more or less continuous braking and delivery operation.

Figure 3:
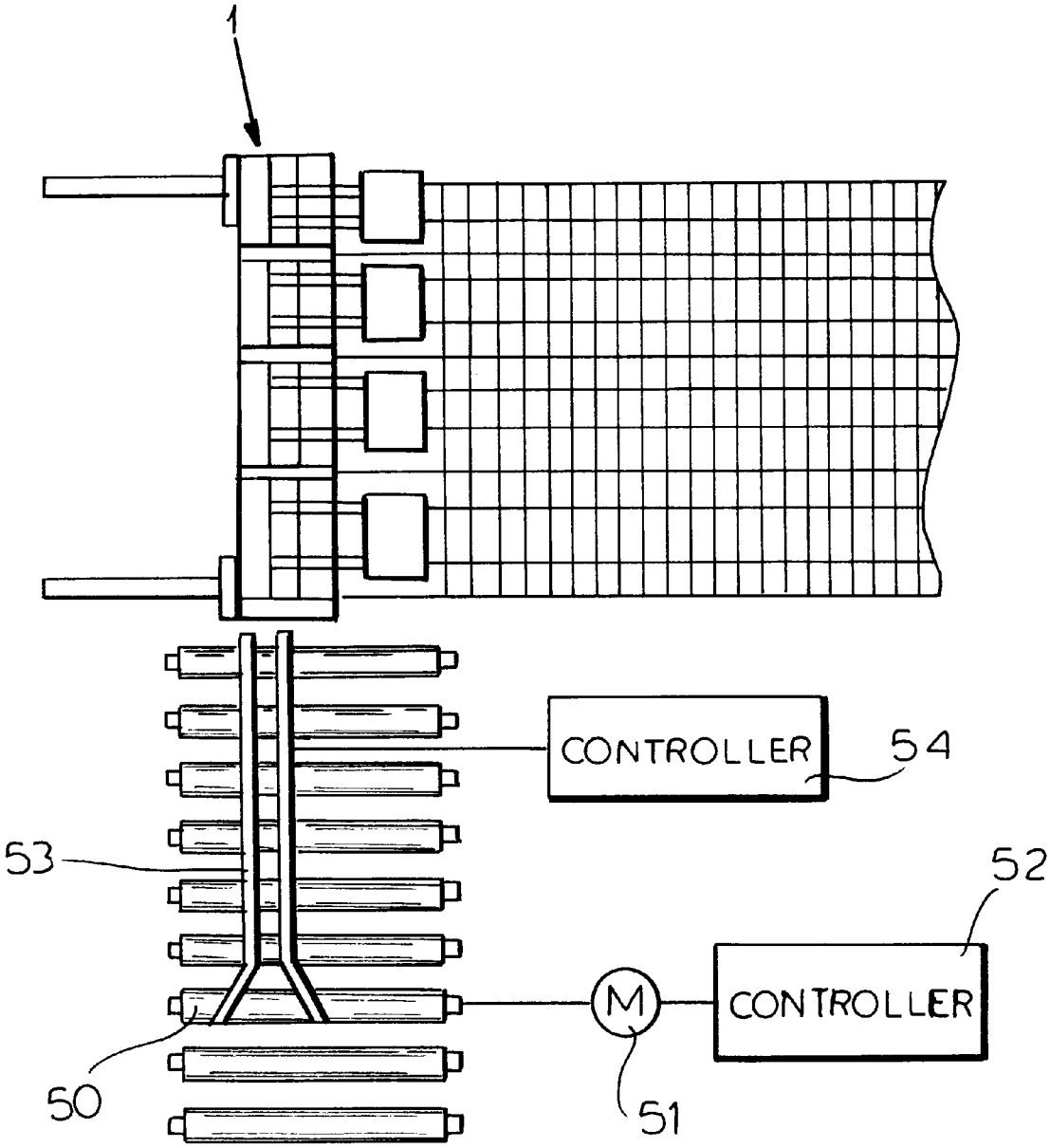
FIG. 3 is a diagrammatic plan view showing other equipment utilized with the braking apparatus of FIGS. 1 and 2.

As can be seen from FIG. 3, the rolled products from the rolling line may be delivered by a lower conveyer 50 which may have motor driven rolls.

A motor 51 for driving the conveyer has been illustrated diagrammatically in FIG. 3 and is operated by the controller 52 so that, for example, the workpieces can be accelerated selectively as they are delivered to the brake unit 1. In addition, a branching or deflecting system can be provided as shown at 53, operated by another controller 54 to deliver the oncoming workpieces either to one or the other arrays of brake members 6.

We claim:

1. An apparatus for braking oncoming rolled products and depositing braked rolled products upon a collector, said apparatus comprising:

an elongated support frame extending in a direction of travel of oncoming rolled products from a rolling line and having at least one brake surface extending in said direction;

a plurality of profiled brake members juxtaposed with said brake surface, spaced apart in said direction and having downwardly extending legs and shanks angled inwardly from said legs toward said frame, said profiled brake members defining compartments with said brake surface receiving a rolled product, said profile brake members confining said compartments laterally and from below; and actuating means connected with said profiled brake members for swinging same in a pendulum movement toward and away from said brake surface transversely to said direction to brake advance of a rolled product between said profiled brake members and said braking surface upon movement of said profiled brake members toward said frame and to enable a braked rolled product to deposit upon a collector upon movement of said profiled brake members away from said frame, said support frame having a rectangular cross section with vertical side walls extending in said direction, each of said brake surfaces comprising a plurality of brake pads spaced apart in said direction and juxtaposed with respective profiled brake members, each of said profiled brake members being of substantially U cross section opening toward the frame, said actuating means including respective levers pivotally connected to said frame above said brake surface and carrying said profiled brake members, said levers being provided with respective arms displaceable by a drive.

2. The apparatus defined in claim 1 wherein said collector is a cooling bed disposed beneath said frame and extending transversely to said direction.

3. The apparatus defined in claim 1 wherein said collector is disposed beneath said frame and extends transversely to said direction.

4. The apparatus defined in claim 1 wherein a respective brake surface is provided on each of two opposite sides of said frame and a respective array of such profiled brake members is juxtaposed with each of said brake surfaces and are swingable toward and away from said frame.

5. The apparatus defined in claim 1, further comprising means for branching oncoming rolled products into two streams, ahead of said compartments.

6. The apparatus defined in claim 1 wherein each of said arms is connected to a respective lever of a profiled brake member on each side of said frame.

7. The apparatus defined in claim 1 wherein said drive is a motor driven cam engaging said arms.

8. The apparatus defined in claim 1 wherein said apparatus further comprises means ahead of said compartments for selectively accelerating said rolled product.

* * * * *